US005620277A

United States Patent [19]

Cole, Sr. et al.

[11] Patent Number: 5,620,277

[45] Date of Patent: Apr. 15, 1997

[54] MARKING AND ANCHORING APPARATUS

[76] Inventors: Novice J. Cole, Sr., P.O. Box 1266, Brentwood, Tenn. 37027; Gary J. Wonzer, 3070 Palm Ave., Ft. Myers, Fla. 33901

[21] Appl. No.: 347,707

[22] Filed: Dec. 1, 1994

[51] Int. Cl.[6] ..... E01F 9/00

[52] U.S. Cl. ..... 404/10; 404/11; 256/1; 256/13.1

[58] Field of Search ..... 404/9, 10, 11; 256/1, 13.1, 19, DIG. 5; 52/155, 157, 161, 162, 98; 248/156, 545

[56] References Cited

U.S. PATENT DOCUMENTS

| | | | |
|---|---|---|---|
| 1,153,450 | 9/1915 | Schaff | 52/155 |
| 1,334,812 | 3/1920 | Snow . | |
| 2,851,135 | 9/1958 | Woodruff, Sr. . | |
| 4,084,914 | 4/1978 | Humphrey et al. | 404/10 |
| 4,092,081 | 5/1978 | Schmanski | 404/10 |
| 4,343,567 | 8/1982 | Sarver et al. | 404/10 |
| 4,522,530 | 6/1985 | Arthur | 404/10 |
| 4,621,940 | 11/1986 | Anderson | 404/10 |
| 4,862,823 | 9/1989 | Hughes | 116/209 |
| 5,028,166 | 7/1991 | Leishman | 404/10 |
| 5,396,743 | 3/1995 | Bellette | 52/154 |

FOREIGN PATENT DOCUMENTS 2309249 8/1974 Germany .

*Primary Examiner*—John M. Sollecito
*Assistant Examiner*—Pamela A. O'Connor
*Attorney, Agent, or Firm*—Myron E. Click

[57] ABSTRACT

A device adapted to be at least partially inserted into an aggregation of material and retained therein. The device has an opening formed therethrough to receive a novel anchoring component. The device may be a marker which advantageously has a Miles Utility configuration, and which has the opening formed in a stake portion of the marker. The anchor has a bridge element which extends through the opening to hold a pair of legs in an opposed and upright position. The legs resiliently grasp the opposite sides of the marker to prevent the anchor from falling out or being bumped out of the opening. There is also disclosed a two-piece marker with the Miles Utility configuration for the post which is resiliently joined to a support to provide a universal hinge action to prevent the wings from being crumpled or permanently deformed to prevent or inhibit the post from returning to an upright position.

39 Claims, 2 Drawing Sheets

26
30
28
46
40
60
54
J
62
56
36
52
58
IV
44
38
B
48
42
67
65
66
50
64
V
34
24
20
35
25
70
68
20a
36b
24a
34b
36a
34a
25a
86
82
84
78
88
80
90
74
72

MARKING AND ANCHORING APPARATUS

BACKGROUND OF THE INVENTION

1. Field of the Invention

This invention relates generally to markers and anchoring apparatus and, in particular to markers which are flexible and resilient in order to self-erect after impact by a vehicle. The anchoring apparatus is particularly useful with such markers, but has other applications as well.

2. Prior Art

Flexible and resilient markers have been the subject of substantial development activity, as reflected by the number of patents issued. One of the first in this area is disclosed in German Patent No. 2,309,249, which was published on Aug. 29, 1974. This patent was directed toward replacement of a single piece rigid tubular rod which had a lower end buried in the ground or connected to a base. When impacted by a vehicle, such a rigid rod was usually destroyed. This patent introduced the idea of connecting a separate rod to a base or a stake rod buried in the ground with an elastic synthetic material. This allowed the rod to take an impact and still be returned to an upright position by the elastic material.

U.S. Pat. No. 4,343,567 discloses an alternative approach in which an outer elongated flexible and resilient marking tube has another inner tube of resilient flexible material nested inside of the outer tube, so that the two resilient tubes cooperate to return the outer marker tube to an upright position. While a tubular flexibly resilient connector is shown in the above-noted German Patent, the upward extension of the inner tube in the '567 patent is supposed to help when the outer marker tube projects several feet above the ground.

U.S. Pat. No. 4,862,823 discloses a marker in which a post portion is connected to a stake portion by an external flexible elastomeric sleeve. This approach was also shown in the above-noted German patent. However, this patent discloses a post and a stake, each of which has a width exceeding its thickness so that the post bends only at the elastomeric sleeve in directions perpendicular to the widths of the post and stake. A mower especially designed for use with this marker can then mow over the markers in the bending directions of the marker, without damaging the markers or the mower while allowing the markers to self-erect after the mower passes.

Examples of other self-erecting markers are shown in U.S. Pat. No. 4,084,914 and 4,092,081.

It has been desired for some time to use a Miles Utility configuration for a marker post. This configuration has a longitudinally extending central tubular section with wings extending outwardly from opposite sides of the central tubular section. The wings add significant signage space without any additional pieces being required. This configuration can be extruded at a low cost from a carbonic-acid polyester of bisphenol A, which is available from Mobay Corporation as MAKROLON (trademark) polycarbonate resin to provide a marker post which has good flexible resiliency at both low and high temperatures. This flexible resiliency is primarily available when impacted from directions substantially perpendicular to the wings. In addition, this configuration provides more visibility with the wings than the cylindrical tube marker. However, off-center impacts, and particularly impacts from the sides of such a post in a direction parallel with the plane defined by the wings may crumple or permanently bend the wings. This crumpling may inhibit or prevent self-erection after an impact. Moreover, even though the post may recover to an acceptable upright position, the crumpling of the wings may not return the top of the post to a position in which the width of the wings is oriented toward the direction of vehicular traffic. This obviously reduces the effectiveness of any reflective materials or signage carried on the top of the post.

Another problem encountered with the Miles Utility configuration has been finding an acceptable and inexpensive way to use that configuration as the stake portion of a marker post. When a pointed stake end has been inserted into the ground by driving or use of a pilot hole, the stake end tends to work its way out of the ground because it does not grasp the ground well. Therefore, expensive and specifically modified separate stakes have been connected to an upper post section using the Miles Utility configuration.

A number of soil anchors have been devised in the past. U.S. Pat. No. 2,851,135 discloses a simple soil anchor having a generally V-shaped cross-section. The anchor is driven into the ground by placing a driving rod in the apex. Straps are attached to each leg of the "V" and extend out of the ground, where the strap ends are coupled together around a pipe or the like being anchored to the ground. Although this anchor is not disclosed as useful with stakes or posts, the apex of the V-shape is rounded which would make it difficult to keep the anchor in an opening formed in a post or stake during normal handling before insertion into the ground. Moreover, the anchor could be accidentally bumped out of the opening very easily. There is no teaching of structure to grasp the sides of a post or stake to prevent separation of the anchor therefrom, because there is no post or stake disclosed.

U.S. Pat. No. 5,028,166 discloses an anchor member 61 used in a flexible guidepost 51 in FIGS. 7 through 10. The anchor has a generally V-shaped configuration with a rounded apex or bend 62 and two legs 63, 64. As discussed above with respect to the '135 patent, the rounded apex makes the anchor vulnerable to falling out or being bumped out of the slot or opening 65. In addition, during impact one of the leg ends may be caught up against a stone or rock, causing the leg to push down against the apex so that the anchor can be held in place and pushed out of the slot as the post is moved upwardly by the impact. The post would then move upwardly along the leg and slip off of the leg when it reaches the end of the leg—thereby losing the anchoring effect. Finally, when the post is driven into dense soil such as clay, the legs can be pinned flat up against each side of the post by the clay. The pinned legs will form a track in the clay as the post is driven into the ground, with a width and depth determined by the width and thickness of the legs. As the ambient air flows in the track, the clay will dry and set up into a very hard surface that will prevent the legs from spreading out to engage the clay. Thus, an impact or other lifting force on the portion of the post sticking out of the ground may be able to remove the post from the ground because the anchor effect has been lost.

U.S. Pat. No. 4,522,530 discloses a soil anchor structure used with a self-erecting tubular marking post which is flexibly resilient. Diametrically opposed holes 34 are formed in the below-ground portion of the marking tube. A pair of spring fingers 35 are secured by rivets to the inside surface of the marker tube and extend out through holes 34 to engage the soil. This is a very expensive approach to the problem, because there are substantial assembly costs and many different parts to be manufactured and kept track of.

U.S. Patent No. 1,334,812 discloses a hollow tubular post having an anchor element with a central portion having four legs connected thereto. When the central portion is positioned within the bore of the tube, the legs extend upwardly along the walls of the bore. The upper tips of the legs are curved outwardly. A block is positioned in the bore on top of and connected to the central portion of the anchor. When the block is pulled upwardly, the outwardly curved ends of the legs engage slots formed in the sides of the post which forces the legs out through the slots into engagement with the ground. As with patent '530 discussed just above, this is a very expensive solution requiring substantial assembly costs, machining, and different parts to be manufactured.

U.S. Pat. No. 1,153,450 discloses outwardly curved spring strips riveted to the stake portion of a guy anchor. Once again this is an expensive approach.

The above review of the prior art reveals the need for new and improved marking and anchor apparatus. Accordingly, it is an object of this invention to provide such improved marking and anchor apparatus.

It is a further object of this invention to provide an improved device to be at least partially inserted into an aggregation of material and retained therein.

It is a still further object of this invention to provide such a device which is a marker having post and stake portions whether such marker is a single-piece unit or a two-piece unit having separate post and stake sections, or in which such device is a guy anchor or the like.

It is another object of this invention to provide such a device which has an improved anchor component.

Yet another object of this invention is to provide an improved anchor component.

Still another object of this invention is to provide an improved two-piece marker which has separate post and stake or base sections joined by an elastomeric hinge.

Other objects, advantages and features of this invention will become apparent when the following description is taken in conjunction with the accompanying drawings.

SUMMARY OF THE INVENTION

A device is disclosed which is to be at least partially embedded in an aggregation of material and retained therein. An article adapted to be embedded in the aggregation has an opening formed therethrough in a position which will be below the surface of the aggregation or ground when embedded therein.

An anchor component has a pair of opposed and spaced legs formed from a flexibly resilient material, each leg having top and bottom ends. A bridge element extends through the opening in the article and connects the bottom ends of the spaced legs for holding the legs in an opposed relationship and directed upwardly toward a surface of the aggregation when embedded therein.

Each anchor leg has a lower portion extending upwardly from the bridge element and an upper portion extending upwardly from a junction portion between the lower and upper leg portions.

The lower leg portions have a configuration in which the leg junction portions are spaced a distance from each other whereby the leg junction portions cooperate with each other to resiliently grasp the sides of the article. The upper portion of each leg is directed outwardly away from the lower portion of each leg and from an opposed leg, enabling the top ends of the legs to engage material in the aggregation to prevent removal of the article from an embedded position.

The article may be a marker having a post portion and a stake portion to be embedded in an aggregation, the stake portion having the above-mentioned opening formed therethrough. Further, the marker may be a single-piece unit formed from a flexibly resilient material which enables the marker to self-erect after an impact. The single-piece marker preferably has a longitudinally extending tubular central section with wings extending outwardly from opposite sides of the tubular central section. The opening in the stake portion accepts the bridge element of the anchor component, enabling the leg junction portions to resiliently grasp the tubular central section. In fact, the leg junction portions may enable collapsing of the flexibly resilient central tubular section to prevent the anchor component from falling or being bumped out of the opening formed in the stake portion.

In one embodiment of the anchor component the bridge element of the anchor component has a length which is less than the distance between the inner surfaces of the tubular central section at the opening therethrough. This allows the bridge element to seat inside of the tubular section in response to an upward force applied to the marker, thereby preventing detachment of the anchor component from the marker in response to the upward force. This bridge element length is similarly useful for the stake portion of the two-piece unit described hereinafter.

The marker may also be a two-piece unit with separate post and stake portions. Both the post and stake portions preferably have longitudinally extending tubular central sections with wings extending outwardly from opposite sides of the tubular central section. The opening formed through the stake portion accepts the bridge element of the anchor component enabling the leg junction portions thereof to resiliently grasp the exterior of the tubular central section.

The two-piece unit further includes means for resiliently joining the post and stake portions which enables the post to tip in any direction with a universal hinge action in response to an inpact. In the preferred embodiment of the two-piece unit, the post and stake portions are sufficiently spaced from each other by the resilient joining means to enable the wings on the post portion to slide by the wings on the stake portion in response to an impact from the side against the post section. This prevents a crumpling or wrinkling of the post wings which would inhibit or prevent the post portion from returning to an upright position. Such crumpling or wrinkling of the wings may also cause the top of the post portion to be out of alignment with respect to vehicular traffic or other visibility important direction.

The resilient joining means may be a piece of elastomeric material having two ends, with one end inserted into the tubular central section of the post portion and the other end inserted into the tubular central section of the stake portion. The elastomeric material is preferably a rod which is resilient enough to return the post portion to an upright position after an impact.

The opening formed through the stake portion of the article may have any configuration or shape that will enable attachment of the anchor component, such as cylindrical (with a circular cross-section). In the preferred embodiment, the anchor component has a scored area formed along the bottom of the connection between each of the legs and the bridge element to provide a hinge action that will prevent the legs/bridge from fracturing or breaking when the legs are spread apart to insert the anchor component in the opening. The scoring also forms laterally extending grasping areas or edges to engage edges of the opening through the stake portion to prevent the anchor component from falling or being bumped out of the opening. The opening configuration that cooperates best with the scoring is one in which the lower edges of the opening are substantially parallel to the surface of the aggregation. This may be a slot-shaped opening or an opening which has a semi-circular cross-section.

Other articles which can utilize this invention include guy anchors. Such anchors have a lower stake portion and an upper portion formed for connection of a guy thereto. The stake portion has an opening formed therethrough to receive an anchor component.

There is also disclosed a novel anchor component which is useful in a number of different applications, as a retaining device for posts, stakes, guy anchors and the like. The anchor device has been described hereinbefore in combination with other articles along with some of the features thereof.

Additional features of the anchor component not already described include an embodiment in which the configuration of the lower portions of the legs are arcuate from the bottom ends away from and then back toward an opposed leg at the leg junction portion. The configuration of the lower portions of the legs in another embodiment is a first upward extension from the bridge element and a second extension back toward an opposed leg at the leg junction portion. In a third embodiment, the configuration of each of the lower portions of the legs is a substantially linear extension upwardly from the bridge element with an inclination toward an opposed leg where the lower portion meets the junction portion of the leg.

The lower portions of the legs preferably have less flexible resiliency than the upper leg portions. This enables the upper portions to more easily flex and thus more easily spread to more deeply penetrate the ground to provide more anchoring capacity. This may be accomplished by forming the lower leg portions with a greater thickness than the upper leg portions.

Another feature of the anchor component is achieved by forming the lower leg portions so that they extend further outwardly away from a device that it is anchoring than the thickness of the upper leg portion. This allows the lower leg portions to form a vertical track in the ground when the device is being inserted into the ground. Thus, the top ends of the upper leg portions extend outwardly and upwardly from the device within the track to prevent the top ends from being pressed and held against a device by dense soil or clay.

The two-piece marker has been described hereinbefore in combination with the novel anchor component. However, the two-piece marker is also novel, and provides functions and advantages not found in the prior art even when not using the novel anchor component.

A number of those features have been described hereinbefore. In addition, when using the elastomeric rod as the resilient joining means, the rod may have longitudinally extending grooves formed therein to ease or aid the insertion of the rod into the tubular central sections of the post and stake portions.

It is preferable if both the post and stake have a Miles Utility configuration in which the tubular central section has a substantially ellipse-shaped cross-section. In this instance, it is also preferable that the rod of resilient material also has a substantially ellipse-shaped cross-section, the outside of the resilient rod having a surface complementary with and fitting inside of the tubular central sections of the post and stake. The ellipse shape of the rod resists permanent torsional deformation in response to an impact that would return the post to an upright position with wings thereof out of alignment with the wings of the stake.

The ellipse shaped resilient rod preferably has longitudinal grooves formed therein to not only ease insertion of the rod into the tubular central sections, but also as an aid to retaining the original orientation of the wings of the post with respect to the wings of the stake after an impact.

In a preferred embodiment, the resilient rod extends upwardly in a tapered form within the tubular central section of the post to provide a further assist in returning the post section to an upright position after an impact.

A second embodiment of the two-piece marker unit, which is also novel apart from and does not use the novel anchor component, includes a post having top and bottom ends. The post advantageously is a Miles Utility configuration with a longitudinally extending tubular central section with wings extending outwardly from opposite sides of the central section.

Flexibly resilient means has top and bottom ends, with the top end of the resilient means being secured to the bottom end of the post. Support means is attached to the bottom end of the resilient means to hold the post at a desired location. The top end of the resilient means is preferably inserted into the tubular central section of the post at the bottom end thereof for acting as a universal hinge to enable the post to tip in any direction in response to an impact.

The resilient means advantageously has a length which spaces the post from the support means so that the wings on the post avoid contact with the support means to prevent crumpling of the wings in response to an impact which would inhibit or prevent the post from returning to an upright position.

It should be noted that the preferred flexible resilient means of the universal hinge means is in the form of an elastomeric rod described in detail herein, because of the many advantages it provides to the combination. However, this does not preclude use of another type of resilient means such as a coil spring, even though all of the advantages of the elastomeric rod may not be obtained.

In the first embodiment of the two-piece marker the support means is a stake. In the second embodiment the support means is a base member having a generally flat bottom surface adapted to be attached to a road surface. Other types of support means may be used in addition to the stake and base member types. The base member has an upper surface defining an opening for receiving the bottom end of the resilient means. The resilient means may also be a rod of elastomeric material as described for the first embodiment, including the longitudinal grooves, the orienting feature for the top of the post, and the upwardly extending tapered portion.

BRIEF DESCRIPTION OF THE DRAWINGS

In the drawings, where like numerals are employed to designate like parts throughout.

DESCRIPTION OF THE PREFERRED EMBODIMENTS

Figures 1, 2, 3, 4, 5, 6, 7:
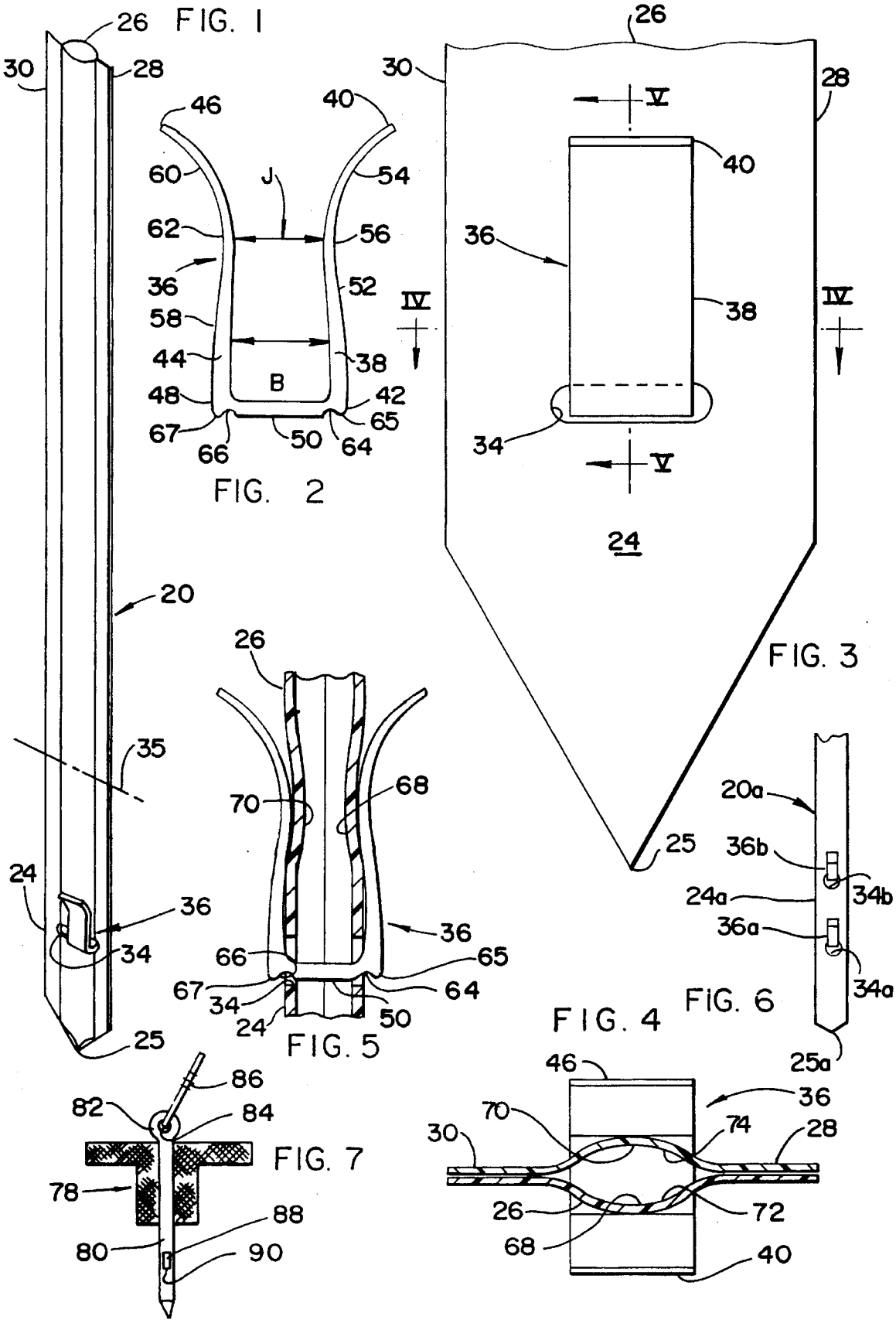
FIG. 1 is a view in perspective of a marker device that embodies the teachings of this invention.
FIG. 2 is a side view of anchor apparatus embodying the teachings of this invention.
FIG. 3 is an enlarged elevational view of the stake portion of the marker device shown in FIG. 1.
FIG. 4 is a cross-sectional view of the stake portion taken at lines IV—IV in FIG. 3.
FIG. 5 is a cross-sectional view of the stake portion taken at lines V—V of FIG. 3.
FIG. 6 is a diagrammatic view of a marker device which utilizes more than one anchor.
FIG. 7 illustrates a guy anchor embodying the teachings of this invention.

Referring now to FIGS. 1 through 5 there is illustrated a first embodiment of this invention. As best seen in FIG. 1 a single-piece marker is generally indicated at 20, which has a post portion 22 and a stake portion 24 having a pointed end 25.

Certain features of this invention are novel by themselves and are useful elsewhere, e.g. the anchor component generally indicated at 36 in FIGS. 1 through 5. However, as noted hereinbefore in the section describing Prior Art, it has been desired to use a Miles Utility configuration as a marker post. The combination shown and described overcomes the difficulties set forth hereinbefore with the use of the Miles Utility configuration designated generally at 20 in FIG. 1, which consists of a member having a longitudinally extending tubular central section 26 and wings or fins 28, 30 extending outwardly from opposite sides of the tubular section 26.

It should be noted that, while the tubular cross-section in the preferred embodiment is substantially ellipse-shaped or oval (See FIG. 5) because it provides important advantages, the cross-section may be annular or otherwise tubularly shaped.

An opening 34 is formed in the stake portion 24 below the ground level or aggregation of material surface 35. One of the applications of this invention is as a marker post along highways or roads, in which the stake will be buried or embedded in the ground. However, the invention may be used with a number of different aggregations of material, such as the ground, piles of sand, piles of raw materials, in snow banks and the like in which signage is needed as an indicator of location or identification or the like. Such an anchor component would have to be located beneath the surface. Such an anchor is indicated generally at 36, located in the opening 34. The opening 34 is shown in FIGS. 1, 3, 4, and 5 as a slot. However, the opening can be cylindrical or have other shapes. In this embodiment it is preferred that the opening have a lower edge that is substantially linear and parallel to the surface of the ground or aggregation to engage score edges as described hereinafter.

The anchor component is most clearly seen in FIG. 2 in a side view by itself. The component in FIG. 2 has a longer bridge element than the component shown in FIGS. 1, 3, 4 and 5 to illustrate how the component is dimensioned for thicker posts or other articles. However, the other parts of the component are identical.

Such an anchor component is useful in retaining devices such as posts, stakes, guy anchors and the like, which have an opening formed therethrough at a below-surface level, secured against removal from an aggregation of material. The anchor 36 includes a pair of opposed and spaced legs 38, 44 formed from a flexibly resilient material such as GEON Vinyl 16344 resin from B. F. Goodrich Co. While plastic is the preferred material, the anchor may also be formed from metals such as spring steel and other metals. Each leg 38, 44 has top ends 40, 46 and bottom ends 42, 48 respectively.

A bridge element 50 extends between and connects the bottom ends 42, 48 of the spaced legs 38, 44, and holds the legs in an upright and opposing relationship. Each leg 38, 44 has a lower portion 52, 58, respectively, extending upwardly from the bridge element 50. Each leg 38, 44 also has an upper portion 54, 60 extending upwardly and flared outwardly from junction portions 56, 62, respectively, between the lower and upper portions.

Each leg 38, 44 has a configuration in which each leg junction portion 56, 62 is disposed so that the leg junction portions 56, 62 cooperate with each other to resiliently grasp the sides of a device when the anchor is installed in an opening 34 of a device such as marker 20, with the opposed legs on opposite sides of the device and the bridge element extending through the opening. In FIG. 2, this configuration is achieved by forming each leg as a substantially linear extension upwardly from the bridge element with an inclination toward an opposing leg where the lower portions 52, 58 meet the junction portions 56, 62, respectively. As shown in FIG. 2, this makes the distance J between the junction portions less than the distance B between the bottom ends of the legs at the bridge element. Thus, the junction portions grasp the opposing sides of the device.

The upper portions 54, 60 of legs 38, 44 are flared or directed outwardly away from the opposing leg, enabling the top ends 40, 46, respectively, to engage the aggregation to prevent removal of a device from an embedded position therein.

The lower portions 52, 58 of legs 38, 44 preferably have less flexible resiliency than the upper portions 54, 60. This enables the upper portions to flex more easily and thus spread apart more easily than the lower portions to more deeply penetrate the aggregation to provide more anchoring capacity. This difference in flexible resiliency may be obtained by forming the lower portions 52, 58 with a greater thickness than the upper portions 54, 60.

It is also desirable for the lower leg portions 52, 58 to extend further outwardly away from the device it is anchoring than the thickness of the upper portions 54, 60. This enables the lower leg portions 52, 58 to form a track in the ground which is as wide as the lower leg portion and as deep as the extension away from the device, when the device is being inserted into the ground. The track allows the top ends 40, 46 of legs 38, 44 to extend outwardly and upwardly from a device being embedded and within the track, to prevent the top ends from being pressed and held against a device by dense soil or clay to prevent engagement with the aggregation.

Figure 11:
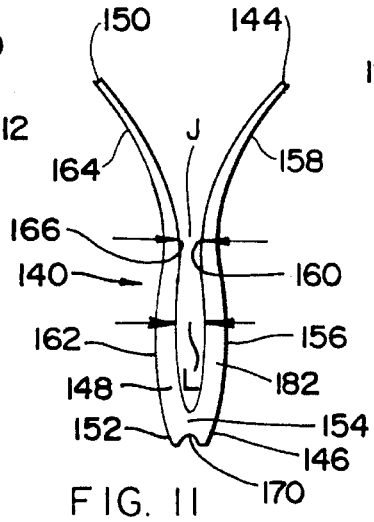
FIG. 11 is a side view of a second embodiment of anchor apparatus, which is used with the marker device of FIG. 8.
Figure 14:
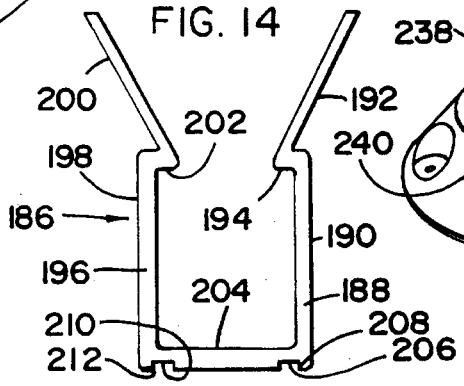
FIG. 14 is a side view of a third embodiment of anchor apparatus.

As best seen in FIG. 2, scored areas 64, 66 are formed along a bottom of the connection between each of the legs 38, 44 and the bridge element 50. This provides a hinge effect between each leg and the bridge, enabling the legs to be spread apart during installation of an anchor component in an opening of a device without breaking or fracturing a leg or a bridge element. The scored areas 64, 66 in FIG. 2 are shown as semi-circular in cross-section, while scored areas 206, 210 in FIG. 14 are shown as rectangular in cross-section. In FIG. 11, because the bridge element is relatively short, there is only one scored area 170. The cross-section of the scores, the depth of the scores, and the location of the scores depend upon the material of the anchor component and the hinging effect needed.

The scored areas in FIGS. 2 and 14 also provide an additional feature. The scores in those two embodiments form laterally extending grasping edges 65, 67 and 208, 212 in FIGS. 2 and 14, respectively. These edges engage the edges of the openings such as 34 to resist movement out of such an opening after installation in a post or device. It is preferred that the bottom edges of the opening be substantially linear and parallel to the surface, so that the grasping edges can be more effective.

Referring now to FIGS. 3 and 4, it can be seen that the anchor component 36 can be dimensioned so that the junction portions 56, 62 of legs 38, 44 actually collapse the flexibly resilient tubular central section 26 of post 20. This insures that the anchor component cannot fall or be bumped out of opening 34.

Referring now to FIG. 6, there is diagrammatically illustrated a marker 20*a* having a stake portion 24*a* in which two openings 34*a* and 34*b* are formed to receive anchor components 36*a* and 36*b*, respectively. Utilizing a plurality of openings and anchor components provides greater anchoring capacity in sandy or loose soils or aggregations, such as piles of materials being identified with signage.

Referring to FIG. 7, this invention is illustrated for use with a guy anchor indicated generally at 78, which has a lower stake portion 80 and an upper portion 82 formed with an eye 84 for connection of a guy line 86. A slot or other opening 90 is formed in the stake portion 80 to receive an anchor component 88, such as shown in FIG. 2. While the guy anchor shown is heavy duty for anchoring utility poles or the like, a light duty structure can be used for anchoring tent stakes or the like, easily and inexpensively.

Referring now to FIGS. 8 through 13 there is shown a two-piece marker system utilizing the teachings of this invention. While the one-piece marker system illustrated in FIGS. 1 through 5 is a very inexpensive and appropriate system for use in many applications, it does have some limitations in applications where there is a significant likelihood that it may receive an off-center or side impact on the post portion. As noted hereinbefore in the Prior Art section, such off-center or side impacts may crumple or permanently bend the wings of the Miles Utility configuration. This crumpling will interfere with, inhibit or prevent self-erection of the post portion after an impact. Such crumpling may also not return the top of the post to a desired orientation for the signage or reflective surface thereon, e.g. in the direction of vehicular traffic.

In addition, when the post portion of a marker extends above the ground too far there may be difficulty with self-erection after an impact. Therefore, a means for assisting the self-erection process would be helpful.

Figure 8:
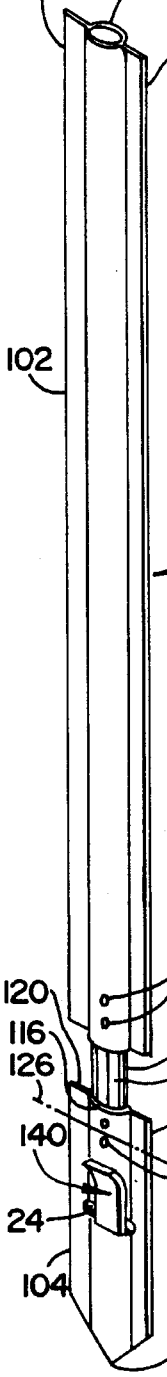
FIG. 8 is a view in perspective of a second marker device that embodies the teachings of this invention.

As best seen in FIG. 8, a two-piece marker designated generally at 100 includes a separate post portion 102, a separate stake portion 104 having a pointed lower end 106, and flexibly resilient means 130 for joining the post and stake portions. The post and stake portions each have longitudinally extending tubular central sections 110, 116 with wings 112, 118 and 114, 120, respectively, extending outwardly from opposite sides of the tubular central section.

The flexibly resilient joining means 130 has top and bottom ends, with the top end being inserted into the bottom end of the tubular central section 110 of the post portion 102. The bottom end of the joining means 130 is inserted into the top end of tubular central section 116. The joining means 130 may be attached to the post and stake portions by rivets 134 or other fastening devices.

As shown in FIG. 4, the Miles Utility configuration has a substantially ellipse or oval shaped cross-section. Although the joining means may have a circular or other cross-section to allow the post portion to tip in any direction in response to an impact and achieve one of the major features of the two-piece marker, it is preferable that the joining means has a substantially ellipse-shaped or oval cross-section in order to obtain another feature of this invention.

With any suitable cross-section the joining means 130 acts as a universal hinge, permitting the post portion 102 to tip in any direction in response to an impact. This prevents the crumpling or other permanent deformation of the wings in particular, and sometimes the central tubular section, that inhibits or prevents the post portion from returning to an upright position, when the bottom ends of the wings of the post portion are anchored to the ground as in the case of the single piece unit. With the universal hinge action a side impact will permit the wings of the post portion to tip toward, but slide by, the wings of the stake portion to prevent the crumpling or deformation.

In addition to the universal hinge action, it is also preferable for the post and stake portions to be spaced sufficiently far apart by the joining means so that contact between the facing bottom end of the post tubular section and the top end of the stake tubular section is avoided, to prevent interference with the universal hinge action. This approach allows the post portion to achieve a 90 degree deflection without damage.

The ellipse-shape of the resilient means provides an additional advantage over other shapes in that it resists permanent torsional deformation that would return the wings to an out-of-alignment position. That is, it prevents the wings from being twisted on the hinge element so that any signage, reflectors, etc. on the post portion remains oriented in a desired viewing direction, e.g. toward oncoming vehicular traffic.

Figure 9:
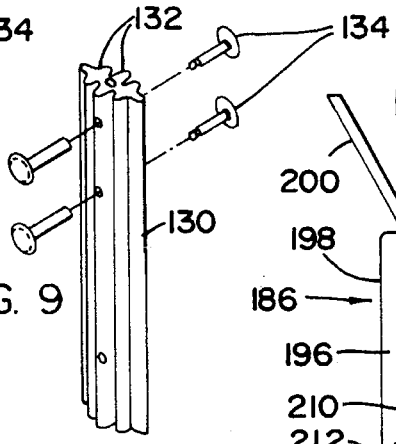
FIG. 9 is an enlarged view of the joining hinge for the post and stake portions in FIG. 8.

As best seen in FIG. 9, vertical longitudinally extending grooves 132 may be formed in the surface of resilient hinge 130. The grooves form ridges between them which exert tension forces to return the post portion to a desired orientation, e.g. with the wings defining a plane that is substantially perpendicular to traffic flow. The grooves also assist in inserting the joining means 130 into the tubular central sections of the post and stake portions.

Figure 10:
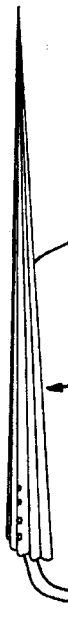
FIG. 10 is a view of a second embodiment of a hinge element useful with the marker device illustrated in FIG. 8.

Referring now to FIG. 10, there is shown a modified hinge element 178, which has tapered portion 180 which will extend upwardly within the tubular central section 110 of the post portion. When the post portion length exceeds a certain distance above the ground, it becomes increasingly difficult for the Miles Utility configuration to self-erect after an impact. In the past, self-erect assisting structures have included a separate second tube or a solid rod nested inside of a cylindrical post or a post having a tubular central section. However, the inner second tube or the solid rod may not slip with respect to an outer tube resulting in a mass build-up at a bending area which will cause a permanent crimp to occur in the post preventing a return to an upright position.

By providing a tapered extension, as at 180 in FIG. 10, an assist for self-erection can be provided without permanent crimps being formed in the post. Such a feature can be also included in the single-piece unit shown in FIG. 1, with the same desirable results.

The joining hinges 130 and 178 may be made by molding or extruding a resin such as TEXIN DP7-1052, available from Mobay Corporation. The grooves may be formed by molding or extruding or machining. With respect to the hinge 178 shown in FIG. 10, the taper with grooves may be molded. Alternatively, the hinge 130 of FIG. 10 could be produced in longer segments, with the taper being provided by machining.

An opening 124 is formed in stake portion 104 below the ground level or aggregation surface 126. An anchor component generally indicated at 140, as best seen in the side view of the anchor alone in FIG. 11, is installed in the opening 124. The anchor 140 includes a pair of opposed and spaced legs 142, 148, and the anchor component may be formed from the flexibly resilient material identified hereinbefore. Each leg 142, 148 has top ends 144, 150 and bottom ends 146, 152, respectively.

A bridge element 154 extends through the opening 124 and between the bottom ends 146, 152 of the legs 142, 148, and holds the legs in an upright position pointing toward the ground or aggregation surface 126 and in an opposing relationship. Each leg 142, 148 has a lower portion 156, 162, respectively, extending upwardly from the bridge element 154. Each leg 142, 148 also has an upper portion 158, 164 extending upwardly from junction portions 160, 166, respectively, between the lower and upper portions.

Figure 12:
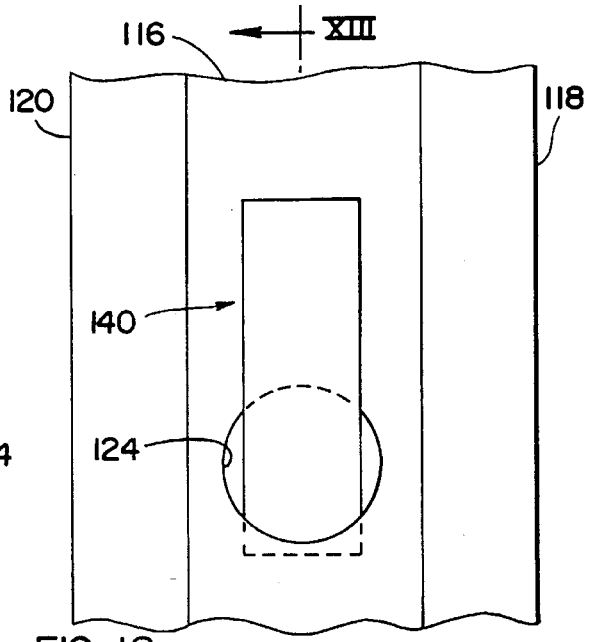
FIG. 12 is an enlarged elevational view of the stake portion of the marker device illustrated in FIG. 8.
Figure 13:
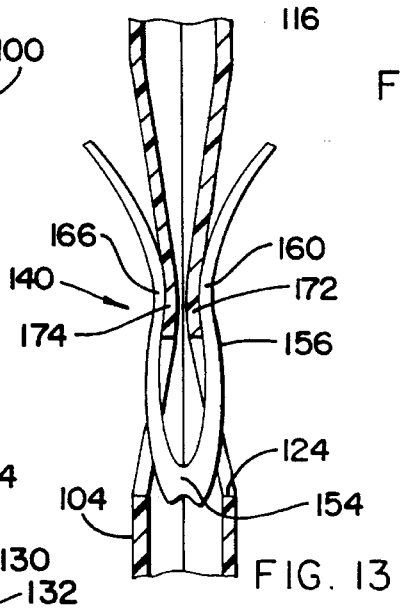
FIG. 13 is a cross-sectional view of the stake portion taken at lines XIII—XIII of FIG. 12.

The opening 124 in the stake is shown in a cylindrical shape. Although other opening shapes can be used, the cylindrical opening is used in this embodiment to take advantage of the anchor component's ability to seat within the inner surfaces of the tubular central section 116 of the stake 104. As best seen in FIGS. 12 and 13, the length of the bridge element 154 is less than the distance between the inner surfaces of the tubular central section 116, thus allowing the bridge element 154 to seat downwardly inside of the tubular section 116 in response to an upward force applied to the two-piece marker 100. This prevents detachment of the anchor 140 out of the opening 124 in stake portion 104.

Each leg 142, 148 has a configuration in which each junction portion 160, 166 is disposed so that the junction portions cooperate with each other to resiliently grasp the sides of the stake portion 104. As best seen in FIGS. 11 and 13, this configuration is achieved by forming the lower portions 156, 162 as arcuate from the bottom ends of the legs away from and then back toward an opposing leg at the leg junction portions 160, 166. Thus, the distance "L" between the lower leg portions is greater than the distance "J" between the leg junction portions 160, 166, and the junction portions resiliently grasp the outer surfaces of the stake, post, or other device.

The upper portions 158, 164 are flared or directed outwardly away from the opposing leg, enabling the top ends 144, 150, respectively, to engage the aggregation to prevent removal of a post, stake or other device from an embedded position therein.

Again, the lower portions 156, 162 of the legs 142, 148 preferably have less flexible resiliency than the upper portions 158, 164. This enables the upper portions to flex more easily and thus spread apart more easily than the lower portions to more deeply penetrate the aggregation to provide more anchoring capacity. Further, the lower portions may stay engaged with the sides of the post, stake or device longer to maintain the resilient grasp thereon. This difference in flexible resiliency can be obtained by forming the lower portions thicker than the upper portions.

As described hereinbefore with respect to the first embodiment of the anchor component, it is desirable for the lower portions of the legs to extend further outwardly to form a track during insertion of the post, etc. into the aggregation. The arcuate configuration in FIGS. 11 and 13 accomplishes this and forms the track, to prevent the upper portions from being pressed and held against the post, device, etc.

Since the bridge element 154 is relatively short, only one scored area 170 is provided to act as a hinge area to assist in spreading legs 142, 148 apart to install the anchor 140 in opening 124. While the scored area is shown as semicircular in cross-section, other shapes resulting from material removal from the bridge/leg connection are acceptable.

As shown in FIG. 13, this embodiment of the anchor 140 can be dimensioned so that the junction portions 160, 166 actually collapse the flexibly resilient tubular central section 110 at 172, 174 of stake portion 104. Again, this insures that the anchor cannot fall or be bumped out of the opening 124.

Referring now to FIG. 14, there is illustrated a third embodiment of an anchor component indicated generally at 186 formed from a flexibly resilient material, which includes a pair of opposed and spaced legs 188, 196 having top and bottom ends. A bridge element 204 extends between and connects the bottom ends of the spaced legs and holds the legs in an upright and opposing relationship.

The difference between this embodiment and the other two lies in the configuration of the legs. Lower leg portions 190, 198 extend upwardly from the bridge element, but leg junction portions 194, 202, respectively, extend back toward the opposing leg. Upper leg portions 192, 200 are flared or directed outwardly from the inner ends of junction leg portions 194, 202.

In operation, the distance between opposed junction leg portions 194, 202 is less than the length of the bridge element extending through an opening. Therefore, the leg junction portions cooperate to resiliently grasp the sides of a post, stake or other device to retain them in the ground or aggregation.

This embodiment also discloses scored areas 206, 210 having rectangular cross-sections, which form grasping edges 208, 212 which help retain the anchor component in an opening in the manner described hereinbefore. As also described before, the scored areas provide a hinge action to allow the legs to be spread apart to install the anchor component in an opening. Further, the lower leg portions 190, 198 extend further outwardly from the device being anchored than the thickness of the upper leg portions, enabling the lower leg portions to form a track in the ground or aggregation to prevent the top ends of the upper leg portions 192, 200 from being pressed and held against a device by dense soil or clay.

Figure 15:
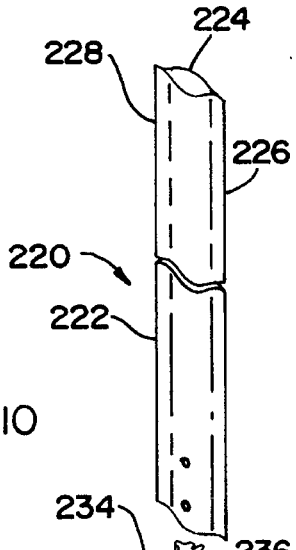
FIG. 15 is partially exploded view in perspective of a third embodiment of a marker device illustrating the teachings of this invention.

Referring now to FIG. 15 there is illustrated generally at 220 a second embodiment of a hinged post or marker 222. The marker preferably utilizes the Miles Utility configuration having a tubular central section 224 with wings 226, 228 extending outwardly from opposite sides of the central section 224. A hinge element 234 such as described hereinbefore has top and bottom ends, with the top end to be inserted into the tubular central section 224 and retained there by rivets or other fasteners.

A base member 230 has a centrally located opening 238 in an upper surface 232 which receives the bottom end of hinge element 234. The opening 238 is shaped to provide a complementary fit to the outside of the bottom of the hinge element 234. Thus, if the exterior of the hinge has a substantially ellipse or oval shape, the opening will have the same complementary inner surface. In FIG. 14, the hinge 234 has longitudinal grooves 236 formed therein, so the opening has ridge shapes on the inner surface thereof to be complementary with the grooves 236. This complementary relationship is important in enabling the hinge to accomplish the re-orienting of the top of post 222 as discussed hereinbefore by holding the bottom end of the hinge very firmly. The hole 240 in base 230 permits inserting a pin through the base and the bottom of the hinge 234 to securely fasten the hinge to the base.

As also discussed hereinbefore, the element 234 acts as a universal hinge to allow marker 222 to tip in any direction. Thus, when the marker receives an off-center impact from the side, the marker tips freely and, since the wings 226, 228 are not anchored to the ground, the wings do not crumple or permanently deform to prevent the marker from self-erecting to an upright position. It is advantageous to provide a hinge element with a length which prevents the bottom of the wings from contacting the base element when tipped to avoid possible deformation from such contact. The hinge element may also be formed with a tapered upper end extending upwardly in the tubular central section (as shown in FIG. 10) to aid in self-erection of the marker.

The base 230 has a frusto-conical outer surface which tapers outwardly from the smaller upper surface 232 to a larger bottom surface to reduce the effect on control of a vehicle when a wheel strikes the base. The larger flat bottom surface may be rigidly attached to a roadway surface by an appropriate adhesive, by bolts anchored in the road surface, or other appropriate attaching means.

While the choice of the specific components and their arrangement in the preferred embodiments herein described illustrate the results and advantages obtained by those specific components over the prior art, the invention is not limited to those components and their arrangement. Thus, the forms of invention shown and described herein are to be taken as illustrative, and changes in the components or their arrangement may be made without departing from the spirit and scope of this invention. There has been disclosed marking and anchoring apparatus which differs structurally from, provides functions not performed by, and has clear advantages over the prior art.

We claim:

1. A device to be at least partially inserted into an aggregation of material and retained therein, comprising:

(a) an article adapted to be embedded in an aggregation of material, said article having an opening formed therethrough in a position which will be below the surface of the aggregation when said article is embedded therein, and (b) an anchor component having a pair of opposed and spaced legs formed from a flexibly resilient material, each leg having top and bottom ends, and also having a bridge element extending through said opening in said article and connecting said bottom ends of said spaced legs for holding said legs in an opposed relationship and directed upwardly toward a surface of the aggregation when embedded therein, (c) said pair of opposed legs being configured to grasp said article to prevent said anchor component from falling out or being bumped out of said opening in said article, (d) each said anchor leg having an upper portion which extends outwardly away from an opposing leg to engage material in the aggregation to prevent removal of said article from an embedded position therein.

2. A device as defined in claim 1 in which (a) each said anchor leg has a lower portion extending upwardly from said bridge element to a junction portion between said lower and upper leg portions, (b) said lower leg portions having a configuration in which said leg junction portions are spaced a distance from each other whereby said leg junction portions cooperate with each other to resiliently grasp sides of said article.

3. A device as defined in claim 1 in which said article is a marker having a post portion and a stake portion to be embedded in an aggregation, said stake portion having said opening formed therethrough.

4. A device as defined in claim 3 in which, the post portion and the stake portion of the said marker device are a single-piece unit, said marker being formed from a flexibly resilient material which enables said marker to self-erect after an impact, said unit having a longitudinally extending tubular central section with wings extending outwardly from opposite sides of said tubular central section, said opening in said stake portion accepting said bridge element of said anchor component enabling said legs to resiliently grasp the exterior of said tubular central section.

5. A device as defined in claim 4 in which said configuration of said legs enables collapsing of said flexibly resilient central tubular section grasped by said legs to prevent said anchor component from falling or being bumped out of said opening formed in said stake portion.

6. A device as defined in claim 4 in which said bridge element has a length which is less than the distance between the inner surfaces of said tubular central section where said bridge extends through said opening, thus allowing said bridge element to seat inside of said tubular section in response to an upward force applied to said marker, thereby preventing detachment of said anchor component from said marker.

7. A device as defined in claim 1 in which (a) said device is a marker formed as a two-piece unit with separate post and stake portions, said post portion having a longitudinally extending tubular central section with wings extending outwardly from opposite sides of said tubular central section, (b) said opening being formed through said stake portion to accept said bridge element of said anchor component whereby said legs grasp the exterior of said stake portion, and (c) which further includes means for resiliently joining said post and stake portions thereby enabling said post to tip in any direction in response to an impact and to prevent a crumpling of said post wings which would inhibit or prevent said post portion from returning to an upright position.

8. A device as defined in claim 7 in which (a) said stake portion also has a longitudinally extending tubular central section with wings extending outwardly from opposite sides of said tubular central section, and in which (b) said opening in said stake portion accepts said bridge element of said anchor component enabling said opposed legs to resiliently grasp the exterior of said tubular central section.

9. A device as defined in claim 8 in which said post and stake portions are sufficiently spaced from each other by said resilient joining means to enable said wings on said post portion to slide by said wings on said stake portion in response to an impact from the side, to prevent a crumpling of said post wings which would inhibit or prevent said post portion from returning to an upright position.

10. A device as defined in claim 8 in which said means for resiliently joining said post and stake portions includes a length of elastomeric material having two ends, one end being inserted into said tubular central section of said post portion and the other end being inserted into said tubular central section of said stake portion.

11. A device as defined in claim 10 in which said piece of elastomeric material is a rod of elastomeric material which is resilient enough to return said post portion to an upright position after an impact.

12. A device as defined in claim 1 in which (a) said opening formed through said article has a configuration which has at least one edge which is substantially parallel to the surface of said aggregation, and (b) in which said anchor component has a scored area formed along a bottom of the connection between a leg and said bridge element which forms a laterally extending grasping edge to engage said at least one edge of said opening to resist movement of said bridge element out of said opening.

13. A device as defined in claim 1 in which said article is a guy anchor having a lower stake portion and an upper portion formed for connection of a guy thereto, said stake portion having an opening formed therethrough to receive said anchor component.

14. An anchor component for use in retaining a device, which has an opening formed therethrough at a below-surface level, secured against removal from an aggregation of material, comprising (a) a pair of opposed and spaced legs formed from a flexibly resilient material, each leg having top and bottom ends, and (b) a bridge element extending between and connecting said bottom ends of said spaced legs holding said legs in an upright and opposing relationship, (c) said pair of opposed legs being configured to grasp such a device when said anchor component is installed in such a device with said bridge element extending through an opening formed in such a device at a below-surface level with said legs extending upwardly on each side of such a device, (d) each of said legs having an upper portion which is directed outwardly away from an opposing leg enabling said upper portion to engage the aggregation to prevent removal of such a device from an embedded position in the aggregation.

15. An anchor component as defined in claim 14 in which (a) each said leg has a lower portion extending upwardly from said bridge element to a junction portion between said lower and upper leg portions, (b) said lower leg portions having a configuration in which said leg junction portions are spaced a distance from each other whereby said leg junction portions cooperate with each other to resiliently grasp sides of such a device.

16. An anchor component as defined in claim 15 in which the configuration of said lower portion of at least one of said legs is arcuate from said bottom end thereof away from and then back toward an opposing leg at said leg junction portion.

17. An anchor component as defined in claim 15 in which the configuration of said lower portion of at least one of said legs is a first upward extension from said bridge element and a second extension back toward an opposed leg at said leg junction portion.

18. An anchor component as defined in claim 15 in which the configuration of said lower portion of at least one of said legs is a substantially linear extension upwardly from said bridge element with an inclination toward an opposing leg where said lower portion meets said junction portion.

19. An anchor component as defined in claim 15 in which said lower portions of said legs have less flexible resiliency than said upper portions of said legs, thereby enabling said upper portions to more easily flex and thus more easily spread to more deeply penetrate the aggregation to provide more anchoring capacity.

20. An anchor component as defined in claim 19 in which said lower leg portions are formed with a greater thickness than said upper leg portions to make said lower leg portions less flexibly resilient than said upper leg portions.

21. An anchor component as defined in claim 15 in which said lower leg portions of each leg extend further outwardly away from such a device it is anchoring than the thickness of said upper leg portions, enabling said lower leg portions to form a track in the aggregation when such a device is being inserted into the aggregation which allows the top ends of said upper leg portions to extend outwardly and upwardly within said track to prevent said top ends from being pressed and held against such a device by a dense aggregation.

22. An anchor component as defined in claim 14 in which a scored area is formed along the connection between each said leg and said bridge element to act as a hinge therebetween enabling said legs to be spread apart during installation of an anchor component in an opening of such a device without fracturing or breaking one of said legs or the bridge element.

23. An anchor component as defined in claim 22 in which said scored area along said bottom of each said leg and said bridge forms laterally extending grasping edges to resist movement of said bridge element out of an opening in a device after installation of an anchor component therein.

24. Marker apparatus, comprising;

(a) a post having top and bottom ends, flexibly resilient means having top and bottom ends with said top end of said resilient means being secured to said bottom end of said post, and means attached to said bottom end of said resilient means for supporting said post at a desired location, (b) said post having a longitudinally extending tubular central section with wings extending outwardly from opposite sides of said tubular central section, (c) said flexibly resilient means acting as a universal hinge to enable said post to tip in any direction in response to an impact from any direction to prevent crumpling of said wings which would inhibit or prevent said post from returning to an upright position.

25. A marker as defined in claim 24 in which said flexibly resilient means has a length defining means for spacing said post from said support means so that said wings on said post avoid contact with said support means after an impact which would cause crumpling and deformation of said wings.

26. A marker as defined in claim 24 in which said support means is a base member having a bottom adapted to be attached to a road surface, said base member defining an opening for receiving said bottom end of said resilient means.

27. A marker as defined in claim 26 in which said resilient means includes a length of elastomeric material formed as a rod which is resilient enough to return said post to an upright position.

28. A marker as defined in claim 27 in which said rod has longitudinal grooves formed therein to ease the insertion of said rod into said tubular central section of said post and into said opening defined in said base member, and to resist permanent torsional deformation that would return said post to an upright position with said wings out of alignment with respect to a desired viewing direction.

29. A marker as defined in claim 27 in which (a) said post has a configuration in which said tubular central section and in which said opening defined in said base member have substantially ellipse-shaped cross-sections, and in which (b) said rod of resilient material also has a substantially ellipse-shaped cross-section with an outer surface that is complementary with and fits inside of said tubular central section of said post and said base member opening, said ellipse-shaped rod resisting permanent torsional deformation that would return said post to an upright position with said wings out of alignment with respect to a desired viewing direction.

30. A marker as defined in claim 27 in which said resilient rod extends upwardly in a tapered form within said tubular central section of said post above said universal hinge section to provide an assist in returning said post section to an upright position after an impact, said tapered form preventing a crimping of said tubular central section which inhibits or prevents the return of a post to an upright position.

31. A marker as defined in claim 24 in which said support means is a stake adapted to be inserted into an aggregation of material.

32. A marker as defined in claim 31 in which (a) said stake has a longitudinally extending tubular central section with wings extending outwardly from opposite sides of said tubular central section, (b) said resilient joining means acts as a universal hinge by enabling said post to tip in any direction with respect to said stake in response to an impact, thereby enabling said wings on said post to slide by said wings on said stake to prevent crumpling of said post wings which would inhibit or prevent said post from returning to an upright position.

33. A marker as defined in claim 32 in which said post and stake are sufficiently spaced from each other by said resilient joining means to prevent contact between facing tubular central section ends of said post and stake which would interfere with said wings sliding by each other.

34. A marker as defined in claim 32 in which said resilient joining means includes a length of elastomeric material having two ends, one end being inserted into said tubular central section of said post and the other end being inserted into said tubular central section of said stake.

35. A marker as defined in claim 34 in which said length of elastomeric material is a rod which is resilient enough to return said post to an upright position after an impact.

36. A marker as defined in claim 35 in which said elastomeric rod has longitudinal grooves formed in the surface thereof to ease the insertion of said rod into said tubular central sections of said post and stake portions.

37. A marker as defined in claim 35 in which (a) said post and stake have a configuration in which said tubular central section has a substantially ellipse-shaped cross-section, and in which (b) said rod of resilient material also has a substantially ellipse-shaped cross-section, the outside of said resilient rod having a surface complementary with and fitting inside of said tubular central sections of said post and stake, said ellipse-shaped rod resisting permanent torsional deformation that would return said post to an upright portion with said wings thereof out of alignment with said wings of said stake.

38. A marker as defined in claim 37 in which said resilient rod has longitudinal grooves formed therein to ease insertion of said rod into said tubular central sections of said post and stake and aid in retaining the original orientation of said post after an impact.

39. A marker as defined in claim 37 in which said resilient rod extends upwardly in a tapered form within said tubular central section of said post above said universal hinge section to provide an assist in returning said post section to an upright position after an impact.

* * * * *